United States Patent [19]

Weber

[11] Patent Number: 4,552,211

[45] Date of Patent: Nov. 12, 1985

[54] HEAT EXCHANGER WITH CONVECTION SUPPRESSING LONGITUDINAL BAFFLES

[75] Inventor: Max Weber, Wiesendangen, Switzerland

[73] Assignee: Sulzer Brothers Limited, Winterthur, Switzerland

[21] Appl. No.: 486,064

[22] Filed: Apr. 18, 1983

[30] Foreign Application Priority Data

Apr. 22, 1982 [CH] Switzerland ..... 2444/82

[51] Int. Cl.[4] ..... F28D 7/02; F28D 7/10; F28F 9/22

[52] U.S. Cl. ..... 165/160; 165/162; 165/163

[58] Field of Search ..... 165/160, 162, 163, 157, 165/158

[56] References Cited

U.S. PATENT DOCUMENTS

| | | | |
|---|---|---|---|
| 3,333,630 | 8/1967 | Charcharos | 165/160 |
| 3,712,370 | 1/1973 | Gilli et al. | 165/163 |
| 4,014,295 | 3/1977 | Lions | 165/160 |
| 4,163,470 | 8/1979 | Johnsen et al. | 165/160 |
| 4,190,104 | 2/1980 | Frei | 165/163 |

FOREIGN PATENT DOCUMENTS

| | | | |
|---|---|---|---|
| 2624621 | 11/1977 | Fed. Rep. of Germany | 165/157 |

*Primary Examiner*—William R. Cline
*Assistant Examiner*—John K. Ford
*Attorney, Agent, or Firm*—Kenyon & Kenyon

[57] ABSTRACT

The heat exchanger has a vertical central tube and a concentric jacket between which support plates extend radially and axially. The support plates carry a bunch of heat exchanger tubes and the jacket is formed near the top and bottom ends with apertures for a heat-yielding medium which flows around the heat exchanger tubes. Separating plates are disposed in registration with the support plates to subdivide the annular chamber extending around the upper end of the central tube and provide a continuation of the flow paths for the heat-yielding medium. These separating plates prevent a circulation of flows between the flow paths defined by the support plates during shut-down.

9 Claims, 2 Drawing Figures

HEAT EXCHANGER WITH CONVECTION SUPPRESSING LONGITUDINAL BAFFLES

Figure 1:
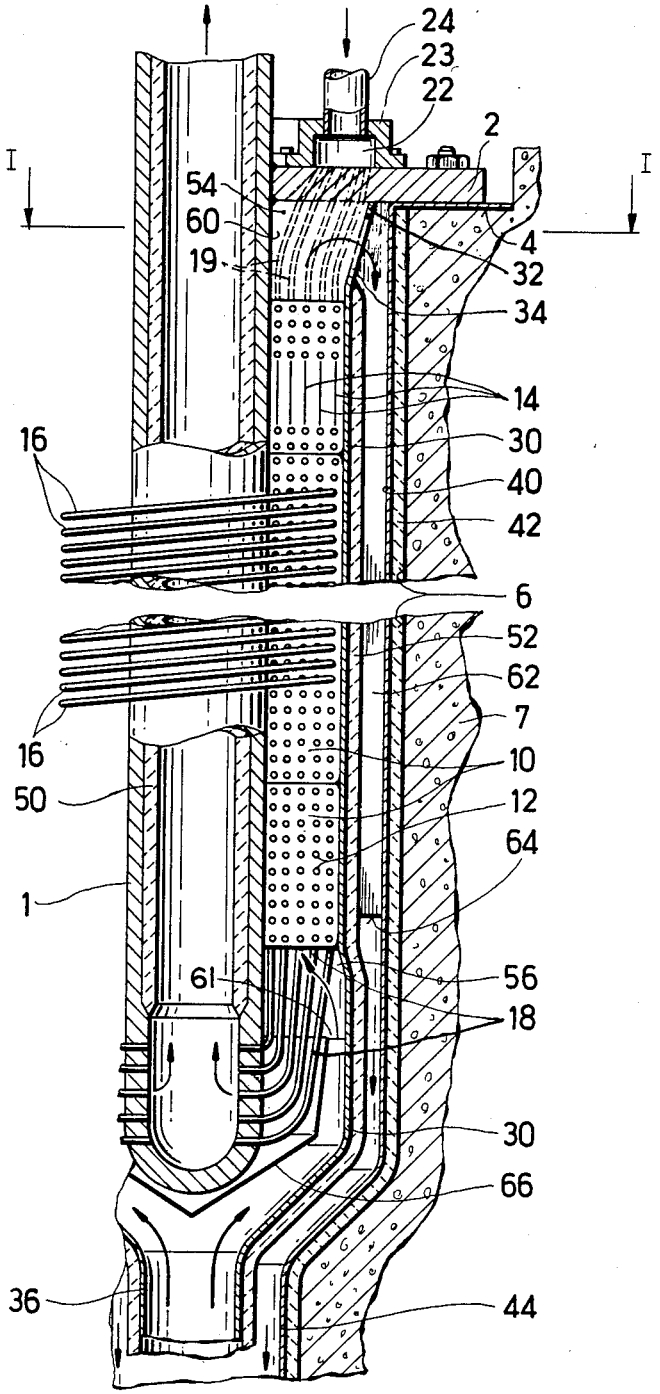

This invention relates to a heat exchanger. More particularly, this invention relates to a mounting arrangement for tubes within a heat exchanger.

Heretofore, heat exchangers have been known which have a vertical central tube from which support plates extend radially and axially as far as a jacket tube which extends coaxially around the central tube. In addition, tube bunches have been carried in the support plates, for example, by being wound helically through apertures in the supporting plates. Further, the top and bottom ends of the jacket tube have usually been provided with openings which communicate with feed and discharge channels for a medium which is to flow over the tubes in heat exchange relation.

It has been found that when a heat exchanger of the above type is bottom-fed with a hot medium for a prolonged period of time, a sudden shut-down of the flow of medium around the heat exchanger tubes causes instability due to temperature layering in the space between the central tube and the jacket. For example, even in the event of a minor disturbance, some of the sector channels formed by the support plates may become riser zones while others become faller zones. The resulting circulation thus causes asymmetrical temperature distributions which may lead to very sever thermal stressing particularly in the central tube and jacket tube.

Accordingly, it is an object of the invention to obviate dangerous temperature distributions caused by thermal instability in a heat exchanger at shut down.

It is another object of the invention to preclude temperature layering from occurring within an annular space of a heat exchanger between a central tube or duct and a concentric jacket.

Briefly, the invention is directed to a heat exchanger comprised of a vertical central tube, a jacket concentric to the tube to define an annular space therebetween, a plurality of support plates which extend coaxially and radially from the central tube to the jacket to sub-divide the annular space into a plurality of parallel flow paths for a first flowable medium and a plurality of heat exchanger tubes which extend within the flow paths between the central tube and jacket to convey a second flowable medium therethrough. In addition, distributing means are connected to the heat exchanger tubes at one end in order to deliver the flowable medium thereto while the tubes are connected to the central tube at the opposite end in order to deliver the medium into the central tube. Outlet means are also provided in the jacket adjacent the distributing means in order to exhaust the first flowable medium from the flow paths between the jacket and central tube.

In accordance with the invention, a plurality of separating plates extend coaxially of the support plates from the support plates to the distributing means in order to define continuations of the flow paths. These separating plates serve to prevent a circulatory flow from one flow path to an adjacent flow path. Even if the separating plates do not provide a total separation between the parallel flow paths, the separating plates do introduce resistances which oppose instability and which retard circulation at least to the extent that the attendant risks become negligible.

Where a supply duct and a discharge duct are provided for the medium which flows over the heat exchanger tubes, the separating plates can be prolonged into the supply and/or discharge ducts to increase their effectiveness.

It is of an advantage to have the support plates and separating plates disposed in an odd number about the periphery of the central duct. This aids in reducing instability.

These and other object and advantages of the invention will become more apparent from the following detailed description taken in conjunction with the accompanying drawing.

Figure 2:
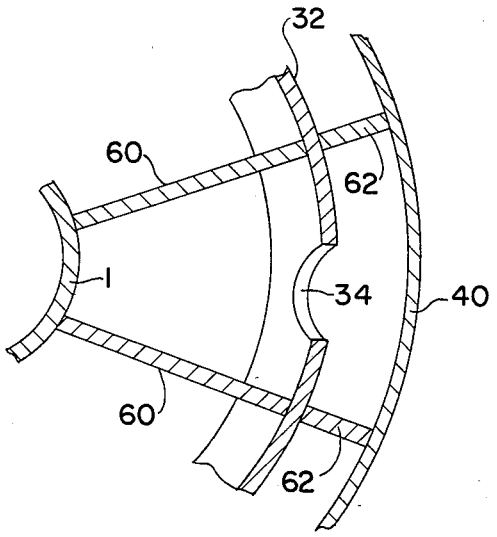

FIG. 1 schematically illustrates a vertical sectional view through a heat exchanger constructed in accordance with the invention; and FIG. 2 illustrates a view taken on line I—I of FIG. 1.

Referring to FIG. 1, the heat exchanger has a vertical central tube or duct 1 which engages via a top flange 2 on a shoulder 4 of a cylindrical aperture 6 in a concrete structure 7. In addition, a plurality (i.e. eight) of support or carrying plates 10 are secured to the central duct 1 in each of five radial planes. Of note, only four plates 10 are illustrated. Each of the plates 10 is provided with a number of bores 12 which are disposed, for example in five vertical rows.

A plurality of heat exchanger tubes 16 extend helically around the central duct 1 through the bores 12 in the plates 10. As indicated, the heat exchanger tubes 16 form five cylindrical surfaces or rows 14 in which the rows form generatrices. As shown, the tubes 16 are sealingly connected to the bottom end of the central duct 1 via bottom tube portions 18 which are bent away from the helices. The bottom end of the duct 1 thus serves as a collecting means. At the top, the heat exchanger tubes 16 are connected via tube portions 19 which are bent from the helices to a distributing means including an annular distribution chamber 22. As shown, the distribution chamber 22 is bounded at the bottom by the flange 2 and by a ring 23 having a cup-shaped or channel-shaped cross-section. In addition, a plurality of supply spigots 24 or the like are distributed over the ring 23 to communicate with the distribution chamber 22 in order to supply a working medium such as a gas thereto.

A jacket 30 is also disposed concentrically to the central duct 1 in order to define an annular space therebetween. As shown, the jacket 30 is suspended from the flange 2 by way of a spacer 32 provided with openings or orifices 34. In addition, the jacket 30 is drawn in conically near the bottom end of the central duct 1 and is connected to a supply spigot 36 for the supply of a working medium such as a gas.

The support plates 10 extend coaxially and radially from the central duct 1 to the jacket 30 in order to subdivide the annular space therebetween into a plurality of parallel flow paths for the gaseous flowable medium. The heat exchanger tubes 16 which extend between the central duct and jacket 30 within these flow paths convey a second flowable medium therethrough in heat exchange relation and deliver the second flowable medium to the central duct 1.

In addition, the aperture 6 is provided with a lining 40 with insulation 42 being disposed between the lining 40 and the aperture 6. The lining 40 is drawn in at the bottom and welded to a collector in the form of an exhaust spigot 44 for a gaseous working medium.

The central duct 1 also has internal insulation 50 and the jacket 30 is provided with external insulation 52.

As indicated above, the vertically aligned support plates 10 subdivide the annular chamber between the central duct 1 and the jacket 30 into five chambers which resemble annular sectors. These chambers further extend above the topmost support plates 10 into an annular chamber 54 between distributing means and plates 10 and below the lowest support plates 10 into an annular chamber 56.

A plurality of separating plates 60 (i.e. five) extend coaxially and radially from the support plates 10 to define continuations of the flow chamber. As indicated, each separating plate 60 extends from the top edge of a support plate 10 through the annular chamber 54 up to the flange 2 and from the central tube 1 to the spacer 32 of the jacket 30. Each plate 60 also abuts a web between two apertures 34 of the spacer 32. As indicated in FIG. 2 the separating plates 60 sub-divide the chamber 54 into section chambers.

A plurality of fins 62 (i.e. five) extend from the separating plates 60 i.e. from a web between an adjacent pair of apertures 34 of the spacer 32 downwardly in the space between the jacket insulation 52 and the lining 40 in the vertical planes of the support plates 10. As shown, each fin 62 terminates at a bottom end 64 which is near the bottom edge of the bottommost support plate 10.

As shown, a cover cap 66 is provided within the heat exchanger below and about the lower end of the central duct 1 and the lower portions of the bent tube portions 18.

The operation of the heat exchanger is as follows:

By way of example, during operation, helium at a temperature of 950° C. flows through the gas supply spigot 36 around the cover cap 66 into the bottom annular chamber 56 between the central duct 1 and jacket 30. The helium then rises while flowing transversely around the heat exchanger tubes 16 to yield heat to the working medium flowing through the heat exchanger tubes 16. The helium then passes upwardly towards the flange 2 into the subchambers formed by the separating plates 60 within the chamber 54. At this time, the helium has cooled to a temperature of about 250° C. The helium then issues through the apertures 34 and flows downwardly through the annular chamber between the jacket insulation 52 and the lining 40 between the fins 62. The helium then discharges via the annular duct between the spigots 36, 44.

A process gas flows into the heat exchanger tubes 16 at a temperature of 300° C. via the distributing means formed by the spigots 24 and distribution chamber 22. This process gas is then heated to about 900° C. within the heat exchanger tubes 16 and thereafter enters into the central duct 1 at the lower end. Thereafter, the process gas rises through the central duct 1.

In the absence of the separating plates 60, should an abrupt interruption of operation occur, the temperature layering in the whole of the annular space between the central duct 1 and the jacket 30 would become unstable. The lighter gas at the bottom would then tend to rise while the heavier gas at the top would tend to fall. This might lead to circulating flows which cause re-layering and, in the end, some temperature equalization. However, until temperature equalization actually occurs, different temperature distributions may arise leading to thermal stressing, particularly in the duct 1 and jacket 30. Such disturbances may be serious if the gas flows upwardly in one sector bounded by two adjacent support plates 10 and down in the adjacent sector since the support plates 10 inhibit lateral mixing and, thus, temperature equalization between the rising warmer gas flow and the descending cooler flow.

However, with the presence of the separating plates 60, such a substantial resistance is produced in the annular chamber 54 to any such circulatory flow as to normally prevent a circular flow from happening at all. Further, with the fins 62 extending as far as to near the lower edge of the bottommost support plate 10, the occurrence of any such circulatory flow is further inhibited since the sector chambers in the annular chamber between the jacket insulation 52 and the lining 40 have a siphon effect.

The effect of providing an odd number of support plates is that a pattern of consecutive riser chambers and faller chambers cannot occur on the periphery of the heat exchanger. This further dampens flow instability.

Depending upon the connection conditions at the bottom annular chamber 56, separating plates 61 may also be provided within this chamber 56. With the connection conditions illustrated, the provision of separating plates in the annular chamber 56 would have the disadvantage of increasing the height of the gas columns participating in the circulation.

With respect to the fins 62, very advantageous conditions are provided when the cross-connection, in the form of the annular chamber 56, between adjacent sector chambers is approximately the same height as the cross-connection, in the form of the annular chamber, below the edge 64 of the fins 62.

Of note, separating plates may also be used in high heat exchangers where the heat exchanger tubes extend not helically but, for example, vertically between a central duct and a concentric jacket.

The invention thus provides a heat exchanger with a relatively simple structure for obviating asymmetrical temperature distributions within the heat exchanger, particularly when there is an abrupt shutdown.

What is claimed is:

1. In a heat exchanger, the combination comprising a vertical central tube;

a jacket concentric to said tube to define a first annular space therebetween;

a plurality of support plates extending coaxially and radially from said central tube to said jacket to sub-divide said annular space into a plurality of parallel flow paths for a first flowable medium;

a plurality of heat exchanger tubes extending between said central tube and said jacket within said flow paths to convey a second flowable medium therethrough for delivery to said central tube;

distributing means spaced from said support plates with an annular chamber therebetween and connected to said tubes at one end thereof to deliver the second flowable medium thereto;

a plurality of separating plates extending through said annular chamber each separating plate extending coplanar with a respective support plate and extending from said support plates to said distributing means to define continuations of said flow paths throughout the annular chamber so as to prevent a circular flow; and outlet means in said jacket adjacent said distributing means to exhaust the first flowable medium from said flow paths.

2. The combination as set forth in claim 1 which further comprises a lining concentric to said jacket to define a second annular space therebetween, said second annular space being in communication with said outlet means to receive the first flowable medium, a collector connected to said second annular space at an end opposite said outlet means, and a plurality of fins coaxially of said support plates and said separating plates for sub-dividing said second annular space.

3. The combination as set forth in claim 1 which further comprises a supply duct connected to said jacket to deliver the first flowable medium to said first annular space.

4. The combination as set forth in claim 1 wherein said separating plates are disposed in an odd number.

5. The combination as set forth in claim 1 wherein said heat exchanger tubes are disposed helically about said central tube and are supported in said support plates.

6. The combination as set forth in claim 1 wherein said tubes are connected to said central tube at one end thereof to deliver the second flowable medium into said central tube.

7. In a heat exchanger, the combination comprising a vertical central tube;

a jacket concentric to said tube to define an annular space therebetween;

a plurality of support plates extending coaxially and radially from said cetral tube to said jacket to sub-divide said annular space into a plurality of parallel flow paths for a first flowable medium;

a plurality of heat exchanger tubes extending between said central tube and said jacket within said flow paths to convey a second flowable medium therethrough for delivery to said central tube;

distributing means connected to said tubes at one end thereof to deliver the second flowable medium thereto;

an annular chamber at a second end of said support plates between said central tube and said jacket; and a plurality of separating plates extending through said annular chamber, each separating plate extending coplanar with a respective support plate and extending from said support plates to define continuations of said flow paths throughout the annular chamber so as to prevent a circular flow.

8. The combination as set forth in claim 7 which further comprises a supply spigot for supplying the first flowable medium between said separating plates in said annular chamber.

9. The combination as set forth in claim 7 wherein said central tube has a bottom end defining a collecting means connected to said heat exchanger tubes to receive the second flowable medium and said separating plates extend to said bottom end.

* * * * *

UNITED STATES PATENT AND TRADEMARK OFFICE

CERTIFICATE OF CORRECTION

PATENT NO. : 4,552,211

DATED : November 12, 1985

INVENTOR(S) : MAX WEBER

It is certified that error appears in the above-identified patent and that said Letters Patent is hereby corrected as shown below:

Column 2, line 8 change "object" to -objects-
Column 3, line 6 change "between distributing" to -between the distributing-
Column 3, line 17 change "2 the" to -2, the-
Column 3, line 18 change "section" to -sector-
Column 3, line 41 change "250°C." to - 350°C-
Column 4, line 56 change "chamber each" to -chamber, each-
Column 4, line 57 change "plate and" to - plate, and-
Column 5, line 27 change "cetral" to - central-
Column 6, line 15 change "plate and" to -plate, and- Signed and Sealed this

*Twentieth* Day of *May 1986*

[SEAL]

*Attest:*

DONALD J. QUIGG

*Attesting Officer*

*Commissioner of Patents and Trademarks*